United States Patent [19]

Bell

[11] Patent Number: 4,494,612

[45] Date of Patent: Jan. 22, 1985

[54] MANUALLY OPERABLE POST DRIVER

[76] Inventor: Harry Bell, 818 E. Shaw St., Charlotte, Mich. 48813

[21] Appl. No.: 468,297

[22] Filed: Feb. 22, 1983

[51] Int. Cl.[3] ..... B25D 1/00

[52] U.S. Cl. ..... 173/1; 173/129; 173/130

[58] Field of Search ..... 173/90, 126, 128–132, 173/171, 1

[56] References Cited

U.S. PATENT DOCUMENTS

| | | | |
|---|---|---|---|
| 299,086 | 5/1884 | Over | 173/90 |
| 391,823 | 10/1888 | Tate et al. | 173/43 |
| 1,646,039 | 10/1927 | Murton | 173/126 X |
| 2,067,890 | 1/1937 | Collord | 173/126 X |
| 2,086,213 | 7/1937 | Collord | 173/126 |
| 2,098,146 | 11/1937 | Hunt | 173/126 |
| 2,348,820 | 5/1944 | Jordan et al. | 173/53 |
| 2,572,370 | 10/1951 | Moeller | 173/91 |
| 2,690,055 | 9/1954 | Lundgren et al. | 405/232 |
| 2,950,603 | 8/1960 | Macek et al. | 173/126 X |
| 2,998,087 | 8/1961 | Iddings | 173/102 |
| 3,015,365 | 1/1962 | Griffin | 173/129 |
| 3,143,817 | 8/1964 | Paulson | 173/126 X |
| 3,207,236 | 9/1965 | Shriner et al. | 173/53 |
| 3,313,346 | 4/1967 | Clevenger | 166/352 |
| 3,454,113 | 7/1969 | Holtz | 173/129 |
| 3,499,497 | 3/1970 | Moore | 173/129 |
| 3,712,389 | 4/1973 | Smoak | 173/126 |
| 3,735,822 | 5/1973 | Deike | 173/126 |
| 3,856,092 | 12/1974 | Mann | 173/126 |
| 4,252,472 | 2/1981 | Moraly | 173/126 X |
| 4,280,567 | 7/1981 | Ijas | 173/129 |
| 4,298,075 | 11/1981 | Sweeney | 173/129 |

*Primary Examiner*—James M. Meister
*Assistant Examiner*—John L. Knoble
*Attorney, Agent, or Firm*—Ian C. McLeod

[57] ABSTRACT

A manually operable post driver for posts (10) including a slide hammer (11) and removable anvil (12) mounted on the post for accomplishing the driving is described. The anvil (12) is rigidly secured by removable nuts (35, 36) on studs (33, 34) to the post (10) intermediate the ends of the post so that the slide hammer can be impacted against the anvil. The driver is particularly suited for U-channel posts (10) having a line of spaced holes (**10*d*) at the bottom (10*a*) of the channel for mounting the anvil and having opposing blunt ends (10*g* and 10*h*). The anvil can be mounted anywhere along the post. Also a sign can be on the post during driving. U-channel posts are commonly used for road signs on highways and have blunt ends (10*g*, 10*h***) which are difficult to drive into the ground by conventional hand driving tools.

17 Claims, 4 Drawing Figures

MANUALLY OPERABLE POST DRIVER

BACKGROUND OF THE INVENTION (1) Field of the Invention

The present invention relates to a manually operable driver for posts (10) including a slide hammer means (11) and a removable anvil means (12). The present invention particularly relates to a post driver for U channel posts (10) with spaced holes (10*d*) along the length intermediate blunt ends (10*g* and 10*h*) for rigidly and removably mounting the anvil means. The driver is particularly adapted for use with highway sign posts.

(2) Prior Art

The prior art has described many different types of manually operable post driving tools. Thus manually operable post drivers are described in U.S. Pat. Nos. 299,086 (Over); 2,067,890 (Collord); 2,086,213 (Collord); 2,098,146 (Hunt); 2,690,055 (Lundgren et al); 2,998,087 (Iddings) 3,143,817 (Paulson); 3,313,346 (Clevenger); 3,712,389 (Smoak); 3,735,822 (Deike); and 3,856,092 (Mann). U.S. Pat. No. 4,252,472 to Moraly describes a peg device which is driven into the ground using a removable stake which is replaced by a post.

The problem with such prior art driving tools is that the slide hammer means impacts on a point or other part of the post at or adjacent to the base of the post as it slides on the post or removable stake. Typical road signs use a blunt ended U shaped channel with no pointed or enlarged portion at the ground end for a slide hammer to strike. As a result, such posts have been driven by hammering on one blunt end opposite the end being driven into the ground. Since the U channel posts are about 6 to 12 feet long, the use of a mechanical hoist requiring at least two workmen is common. Once one of the workmen is lifted to the proper height the post is hammered into the ground with a sledge hammer or the like. This method is slow and expensive because of the labor and machinery required.

OBJECTS

It is therefore an object of the present invention to provide a manually operable, slide hammer type post driver, particularly adapted for driving blunt ended U-channel posts, which can be used by one workman from the ground without any other tools or equipment. It is further an object of the present invention to provide a method for driving posts. Finally, it is an object to provide a method and post driver which is inexpensive to construct and simple to use. These and other objects will become increasingly apparent by reference to the following description and the drawings.

IN THE DRAWINGS

GENERAL DESCRIPTION

Figure 1:
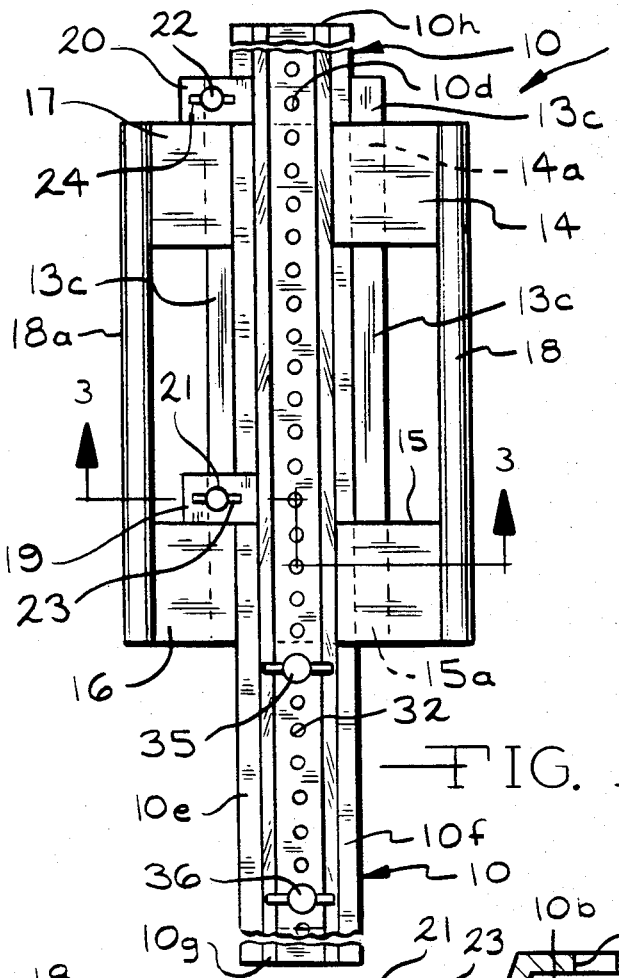
FIG. 1 is a front view illustrating a preferred post driver of the present invention and in particular a first side of the post driver including slide hammer means (11) and anvil means (12) which are mounted on a blunt end U-channel post (10).

The present invention relates to a manually operable post (10) driver unit which comprises: slide hammer means (11) manually slideable and reciprocally movable on a segment along the post between two opposing ends (10*g* and 10*h*) with hand holding members (18 and 18*a*) on the hammer means for manual operation; and anvil means (12) with securing means for removable rigid mounting intermediate to the ends of the post adjacent to the segment of movement of the hammer means, wherein in use the slide hammer means impacts the anvil means to drive or remove the post from the ground.

The present invention particularly relates to a manually operable post driver unit for driving a channel type post (10) having a U shaped cross-section and having a bottom (10*a*) and two opposite legs (10*b*, 10*c*) and lateral extensions (10*e* and 10*f*) and having multiple holes (10*d*) in the bottom along a length between two ends (10*g*, 10*h*) of the post which comprises: slide hammer means (11) including a plate member (13) with at least two opposed post gripping means (14*a*, 15*a*, 19 and 20) which engage the post so as to be slideably connected to the extensions (10*e* and 10*f*) of the post for sliding reciprocating movement along the length of the post and with hand holding members (18 and 18*a*) on the hammer means for hand movement of the hammer means and with a hammer head (25) mounted on the plate so as to be positionable on the U shaped cross section of the post between the legs and adjacent the bottom; and anvil means (12) having a flat surface (30*c*) which fits in contact with the bottom of the post and between the legs with securing means for removably and rigidly mounting the anvil means to the post, wherein the flat surface has multiple projecting dowel pins (32) mated to several of the holes in the bottom of the post and wherein in use the hammer head on the slide hammer is manually impacted against the anvil means attached to the post to drive the post into or remove the post from the ground.

The present invention further relates to an anvil means (12) adapted to be secured to a channel type post (10) having a U shaped cross-section with a bottom (10*a*) and two opposite legs (10*b*, 10*c*) and having multiple holes (10*d*) in the bottom along a length between two ends (10*g*, 10*h*) of the post and mountable on the post for use with a slide hammer means (11) slideable along the post between the two opposing ends which comprises: a bar member (30) having a length between two opposing ends (30*a*, 30*b*) and adapted to mount along the bottom and between the legs of the post and with at least one projection or dowel pin (32) along the length which extends into one of the holes in the bottom of the post; and holding means (33, 34, 35, 36) on the bar member for rigidly mounting the bar member to the post, wherein the bar member can be hammered at either end by a slide hammer means to drive the post into or remove the post from the ground.

Finally the present invention relates to the method for driving a post which comprises: mounting on a post a manually operable post driver including slide hammer means (11) manually slideable and reciprocally movable on a segment along the post between two opposing ends (10*g* and 10*h*) with hand holding members (18 and 18*a*)

on the hammer means for manual operation and including an anvil means (12) with securing means for removable rigid mounting intermediate to the ends of the post adjacent to the segment of movement of the hammer means, wherein in use the slide hammer means impacts the anvil means to drive or remove the post from the ground; and impacting the slide hammer means on the anvil means to drive or remove the post from the ground.

SPECIFIC DESCRIPTION

Figure 2:
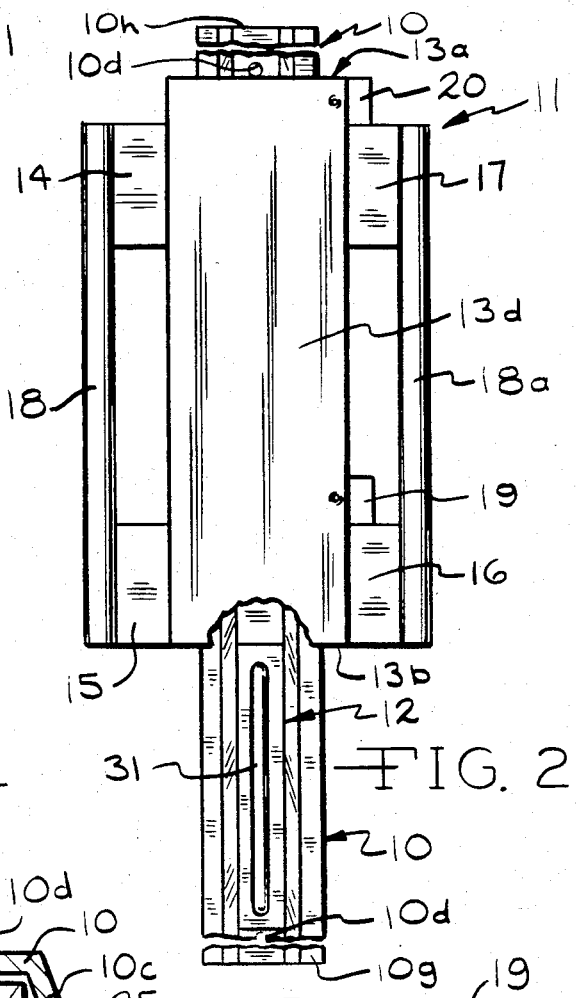
FIG. 2 is a front view of the preferred post driver on the second side opposite to the first side shown in FIG. 1.
Figure 3:
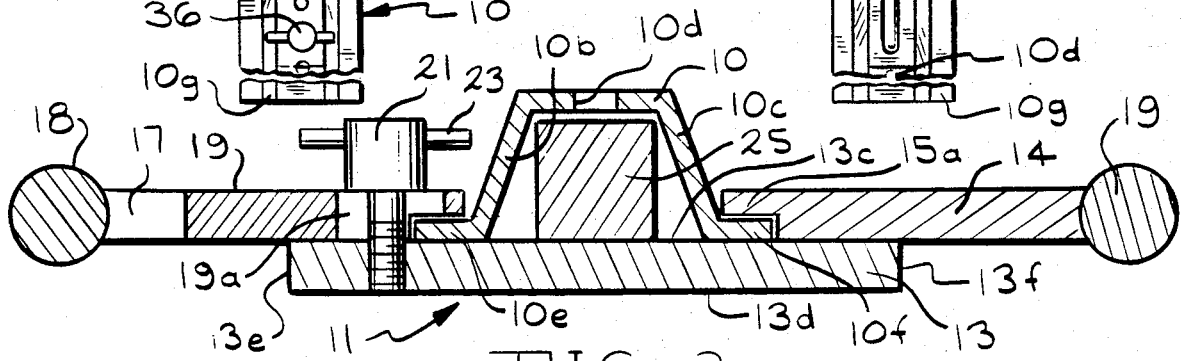
FIG. 3 is a side cross-sectional view along line 3—3 of FIG. 1, particularly showing the slideable connection of the slide hammer means (11) to the post (10).
Figure 4:
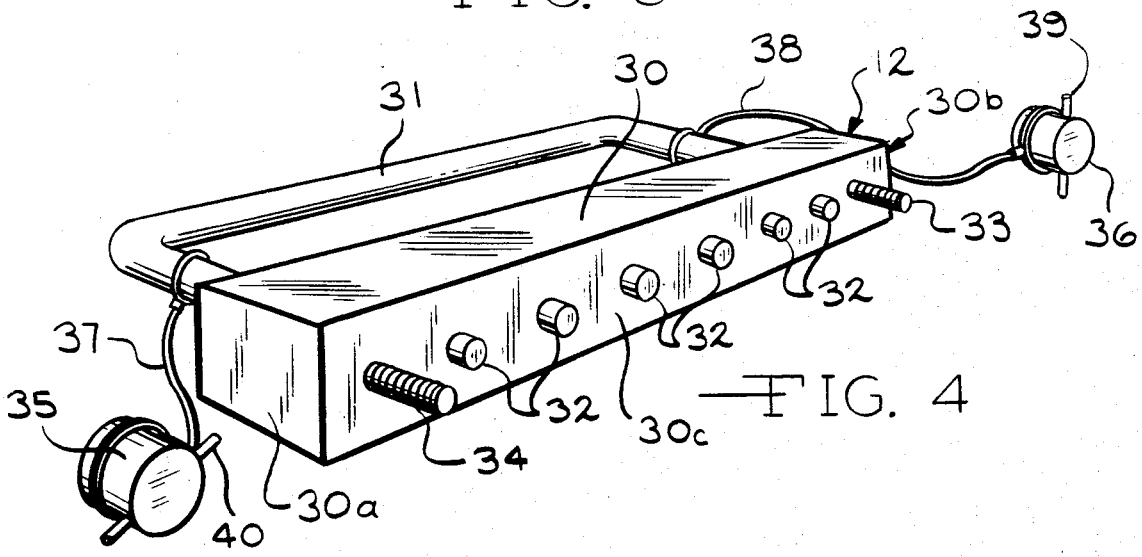
FIG. 4 is a front isometric view of the anvil means (12) shown in FIG. 2 which rigidly mounts in holes (10*d*) of post (10) by means of nuts (35 and 36) and studs (33 and 34) with hardened projections or dowel pins (32) which fit into the holes in the post.

The preferred impact driver unit of the present invention is shown in FIGS. 1 to 3 mounted on a post 10. The post 10 is of the U channel type with a bottom 10*a*, two opposite legs 10*b* and 10*c*, holes 10*d* along the bottom 10*a* at regular intervals and lateral extensions 10*e* and 10*f* from legs 10*b* and 10*c*. As shown the post 10 has two blunt ends 10*g* and 10*h*.

The driver unit includes a slide hammer means 11 and an anvil means 12. The hammer means 11 includes a flat plate 13 having ends 13*a* and 13*b*, wide sides 13*c* and 13*d* and narrow sides 13*e* and 13*f*. On one wide side 13*c* adjacent to each narrow side 13*e* and 13*f* of the plate 13 are secured lugs 14 and 15, 16 and 17 which support holders or rods 18 and 18*a* which can be held in each hand to move the slide hammer 11 along the length of the post 10 in a slideable and reciprocal motion. The lugs 14 and 15 are provided with protrusions 14*a* and 15*a* which overlap lateral extension 10*f* of the leg 10*c* in contact with the one wide side 13*c* of plate 13. Adjacent to the lugs 16 and 17 are removable post holding members 19 and 20 which overlaps lateral extension 10*e* and are secured to the one side 13*c* of post holding plate 13 by means of bolts 21 and 22 provided with pins 23 and 24 to aid in tightening the bolts 21 and 22. The holding members 19 and 20 have a slot 19*a* (FIG. 3) for lateral adjustment towards or away from the post 10. An impacting member 25 is mounted on the one side 13*c* of plate 13 so as to be located in the channel of the post 10.

The anvil means 12 includes a bar member 30 with an optional handle 31. On a side 30*c* opposite the handle 31 are projections or hardened dowel pins 32 which removably mate with holes 10*d* in post 10. Studs 33 and 34 are provided on the side 30*c* which have a smaller diameter than holes 10 so that shearing force on the anvil means 12 is always on projections 32. The studs 33 and 34 are provided through holes 10 and nuts 35 and 36 rigidly secure the anvil means 12 to the post 10. Flexible wires 37 and 38 are attached to nuts 35 and 36 to prevent loss. Nuts 35 and 36 are provided with pins 39 and 40 to aid in tightening.

In operation, the anvil means 12 is positioned on the post 10 on the bottom 10*a* using handle 31 with the studs 33 and 34 and projections 32 positioned in holes 10*d*. The height is preferably between about the knees and the shoulders of the standing workman in the driving position. Since the projections 32 have a close fit with holes 10*d* and the studs 33 and 34 have a loose fit, all of the driving shear forces will be borne by the projections 32. The nuts 35 and 36 are tightened on studs 33 and 34 to rigidly attach the anvil means 12 to the post 10. The slide hammer means 11 is positioned above (or below) the anvil means 12 with the wide side 13*c* against the post 10 and the holding members 19 and 20 protrusions 14*a* and 15*a* over the lateral extensions 10*e* and 10*f* of the post 10. Bolts 21 and 22 are tightened. The holding members 19 and 20, the protrusions 14*a* and 15*a* and the one side 13*c* of plate 13 provide a loose sliding fit with the post 10. The impacting member 25 is then forcibly contacted with the bar 30 at end 30*a* or 30*b* by reciprocating the slide hammer 11 using a downward hammering motion. In this manner the post 10 is driven into the ground. Likewise the slide hammer 11 can be positioned below the anvil means 12 to remove the post 10 from the ground by hitting the anvil means 12 using an upward hammering motion.

As shown in FIG. 3, the bolts 21 and 22 are adjacent to the extension 10*e* and must be almost completely removed for mounting of the slide hammer 11 on post 10 by holding members 19 and 20. The bolts 21 and 22 can be moved more towards the side 13*e* to provide mounting of the slide hammer 11 on the post 10 by the holding members 19 and 20 without removal of the bolts 21 and 22.

Numerous variations of the slide hammer means 11 and anvil means 12 will occur to those skilled in the art. The anvil means 12 could be secured to the post 10 by clamping or the like (not shown) although this is not preferred. Holes can be drilled in the post if necessary. The slide hammer means 11 can have a variety of configurations so long as there is a hammering of the anvil means 11. The distinct advantage of the present invention is that the sign can be on the post when it is driven into the ground which saves time. Power equipment, such as an air hammer, can be used to drive the anvil means rather than the slide hammer. Other modifications will occur to those skilled in the art and are included in the present invention.

I claim:

1. A manually operable post (10) driver unit for posts with a U-shaped cross-section with a bottom (10*a*), two opposite legs (10*b*, 10*c*) and lateral extensions (10*e* and 10*f*) from each leg and having two opposing ends (10*g* and 10*h*) which can be blunt which comprises:

(a) slide hammer means (11) manually slideable and reciprocally movable on a segment along the post between the two opposing ends (10*g* and 10*h*) of the post with retaining means (14*a*, 15*a*, 19 and 20) which removably engage the lateral extensions of the post, the retaining means including at least one post engaging member on the slide hammer means slideably engaging each of the lateral extensions of the post and wherein at least one of the post engaging members is disengageable from the post extension to allow removal of the slide hammer means from the post and with hand holding members (18 and 13*a*) on the hammer means for manual operation and with a hammer head on the hammer means; and (b) anvil means (12) with securing means for removable rigid mounting of the anvil means on the post intermediate to the ends of the post adjacent to the segment of movement of the hammer means and wherein in use the hammer head of the slide hammer means impacts the anvil means to drive or to remove the post from the ground.

2. The post driver unit of claim 1 wherein the anvil means is secured to the post by threaded means which are provided through holes in the post as the securing means.

3. The post driver unit of claim 1 wherein the slide hammer means includes a plate member (13) having two opposite narrow sides (13*e* and 13*f*) and two opposite wide sides (13*c* and 13*d*), wherein one wide side (13*c*) slides on the post between the narrow sides and wherein hand holding members are provided on the plate member adjacent to each of the narrow sides.

4. The post driver unit of claim 3 wherein the hand holding members include at least two lugs (14, 15, 16, 17) which are provided on the one wide side of the plate member adjacent each of the narrow sides and wherein rods (18, 13*a*) are provided on the lugs adjacent each narrow side for gripping the slide hammer means by hand.

5. The post driver unit of claim 4 wherein one lug adjacent one narrow side (13*f*) of the plate member has a protrusion (14*a*, 15*a*) which slideably engages one lateral extension of the post as one post engaging member and wherein the other post engaging member which is disengageable is provided adjacent the other narrow side (13*e*) of the plate member.

6. The post driver of claim 1 wherein the anvil means includes at least one stud (33, 34) and nut (35, 36) as the securing means for removably mounting the anvil means through a hole (10*d*) provided in the post.

7. A manually operable post driver unit for driving a channel type post (10) having a U shaped cross section and having a bottom (10*a*) and two opposite legs (10*b*, 10*c*) and lateral extensions (10*e* and 10*f*) from the legs and having multiple holes (10*d*) in the bottom along a length between two ends (10*g*, 10*h*) of the post which can be blunt which comprises:

(a) slide hammer means (11) including a plate member (13) with at least two opposed post retaining means (14*a*, 15*a*, 19 and 20) which engage the post so as to be slideably connected to the lateral extensions (10*e* and 10*f*) of the post for sliding reciprocating movement along the length of the post the retaining means including at least one post engaging member on the slide hammer means slideably engaging each of the lateral extensions of the post and wherein at least one of the post engaging members is disengageable from the post extension to allow removal of the slide hammer means from the post and with hand holding members (18 and 18*a*) on the hammer means for hand movement of the hammer means and with a hammer head (25) mounted on the plate so as to be positionable in the U shaped cross section of the post between the legs and adjacent the bottom; and (b) anvil means (12) having a flat surface (30*c*) which fits in contact with the bottom of the post and between the legs with securing means for removably and rigidly mounting the anvil means to the post, wherein the flat surface has multiple projecting dowel pins (32) mated to several of the holes in the bottom of the post and wherein in use the hammer head on the slide hammer is manually impacted against the anvil means attached to the post to drive the post into or remove the post from the ground.

8. The post driver unit of claim 7 wherein the post engaging member which is disengageable is secured by a bolt (21, 22) on one side of the plate member adjacent one extension (10*e*) of the post for attachment and removal of the slide member from the post and on the other side of the plate member at least one lug (14, 15) secured to the plate member has a protrusion (14*a*, 15*a*) which engages the second extension (10*f*) of the post (10).

9. The post driver unit of claim 8 wherein there are two lugs and two post engaging members.

10. The post driver of claim 8 wherein the plate member is rectangular with two opposite narrow sides (13*e*, 13*f*) and two opposite wide sides (13*c*, 13*d*) with one wide side (13*c*) which slides along the post and wherein handle members (18, 18*a*) are provided adjacent to the two narrow sides so as to be gripped by both hands for reciprocating the slide hammer means against the anvil means to drive the post.

11. The post driver of claim 7 wherein the holding means for securing the anvil means is a threaded member (33 and 34) which fits into corresponding holes in the post and is mounted by a nut (35 and 36).

12. The post driver of claim 11 wherein the nut is secured to the anvil means by a flexible connection means (37, 38).

13. An anvil means (12) adapted to be secured to a channel type post (10) having a U shaped cross-section with a bottom (10*a*) and two opposite legs (10*b*, 10*c*) and having multiple holes (10*d*) in the bottom along a length between two ends (10*g*, 10*h*) of the post and mountable on the post for use with a slide hammer means (11) slidable along the post between the two opposing ends which comprises:

(a) a bar member (30) having a length between two opposing ends (30*a*, 30*b*) and adapted to mount along the bottom and between the legs of the post and with at least one projection (32) along the length which extends into one of the holes in the bottom of the post; and (b) holding means (33, 34, 35, 36) on the bar member extending through at least one of the holes in the post so that the projection bears impact loads of the slide hammer with a removable portion holding the holding means on the post secured to the bar member by a flexible connection means (37) for rigidly mounting the bar member to the post, wherein the bar member can be hammered at either end by a slide hammer means to drive the post into or remove the post from the ground.

14. The anvil means of claim 13 wherein the holding means is a threaded means which mounts through the holes in the post and wherein the removable portion is a nut (35, 36) secured to the bar member by the connection means.

15. The anvil means of claim 13 wherein the bar member has an essentially rectangular cross-section.

16. The method for driving a post with a U-shaped cross-section with a bottom (10*a*), two opposite legs (10*b*, 10*c*) and lateral extensions (10*e* and 10*f*) from each leg and having two opposing ends (10*g* and 10*h*) which can be blunt which comprises:

(a) mounting on a post a manually operable post driver including slide hammer means (11) manually slideable and reciprocally movable on a segment along the post between the two opposing ends (10*g* and 10*h*) of the post with retaining means (14*a*, 15*a*, 19 and 20) which removably engage the lateral extensions of the post the retaining means including at least one post engaging member on the slide hammer means slideably engaging each of the lateral extensions of the post and wherein at least one of the post engaging members is disengageable from the post extension to allow removal of the slide hammer means from the post and with hand holding members (18 and 18*a*) on the hammer means for manual operation and with a hammer head (25) on the hammer means and including anvil means (12) with securing means for removable rigid mounting of the anvil means on the post intermediate to the ends of the post adjacent to the segment of movement of the hammer means and wherein in use the hammer head of the slide hammer means impacts the anvil means to drive or to remove the post from the ground;

(b) impacting the slide hammer means on the anvil means to drive or remove the post from the ground; and (c) disengaging the disengageable post engaging member and thus the slide hammer and the anvil means from the post.

17. The method of claim 16 including the additional step of drilling holes in the post and then mounting the anvil means to the post using threaded means.

* * * * *